US008033285B2

(12) United States Patent
Fitz et al.

(10) Patent No.: US 8,033,285 B2
(45) Date of Patent: Oct. 11, 2011

(54) GROOMING STATION

(76) Inventors: Joseph R. Fitz, Yoe, PA (US); Janie Wilke, Red Lion, PA (US)

( * ) Notice: Subject to any disclaimer, the term of this patent is extended or adjusted under 35 U.S.C. 154(b) by 521 days.

(21) Appl. No.: 12/263,640

(22) Filed: Nov. 3, 2008

(65) Prior Publication Data

US 2010/0108087 A1 May 6, 2010

(51) Int. Cl.
*A45D 29/20* (2006.01)
*A45D 29/18* (2006.01)

(52) U.S. Cl. ..... 132/75; 132/73.5

(58) Field of Classification Search ..... 132/75, 132/73.5, 76.5, 73; 211/39, 11, 128.1; D6/519; D28/61
See application file for complete search history.

(56) References Cited

U.S. PATENT DOCUMENTS

| | | | | | |
|---|---|---|---|---|---|
| 2,808,191 | A | * | 10/1957 | Cramer | 206/562 |
| 2,816,556 | A | * | 12/1957 | Weber et al. | 132/75 |
| 2,842,141 | A | * | 7/1958 | Rodrigues, Jr. | 132/73.5 |
| 4,321,935 | A | * | 3/1982 | Sussman | 132/73 |
| D288,883 | S | * | 3/1987 | Loughridge | D6/519 |
| 6,035,857 | A | * | 3/2000 | Hartelius et al. | 132/73 |
| 6,349,729 | B1 | * | 2/2002 | Meyer et al. | 132/73.5 |
| 2006/0080972 | A1 | * | 4/2006 | Krieger et al. | 62/3.3 |

* cited by examiner

*Primary Examiner* — Robyn Doan
(74) *Attorney, Agent, or Firm* — Michael L. Greenberg, Esq.; Greenberg & Lieberman, LLC

(57) ABSTRACT

A hand grooming station, specifically for nails, which permits a user to paint, polish or otherwise groom his or her fingernails in a comfortable and unobtrusive manner via an elevated ramp while care products are easily recognizable and organized. In addition, the base is formed with a curvature and structural support to provide stability while a lip relates to a raised edge to contain spillage.

1 Claim, 2 Drawing Sheets

GROOMING STATION

FIELD OF THE INVENTION

The present invention is a hand grooming station, specifically for nails, which permits a user to groom his or her fingernails in a comfortable and unobtrusive manner via an elevated ramp while care products are easily recognizable and organized. In addition, the present invention is formed with a curvature and structural support to provide stability while a lip relates to a raised edge to contain spillage.

BACKGROUND OF THE PRESENT INVENTION

Polished fingernails are a necessity for many people. In addition, people ranging in age from their early teens up to when they become elderly engage in such grooming activity. Professional manicures also can be expensive for some people, while others merely may wish to paint and polish their own fingernails. The present invention is geared to those who want to care for their own fingernails in an organized, comfortable, clean and efficient manner.

Typically, many people possess a bag or carrying case that contains the multitude of fingernail polish. This means that many bottles featuring varying colors and brands are stuffed into at least one bag. In addition, other related items dealing with such aspects as cuticles, filing and clipping also are scattered throughout. This creates a problem of organization, as the bag often must be emptied of its contents so that a particular color or brand can be utilized. The present invention solves this problem by forming holes into an organizational surface that are elevated and supported by intermittently placed platforms. The bottles can be placed into the holes. Meanwhile, because the platforms elevate the organizational surface, the placement of these platforms permits the user a clear line of sight to instantly identify the varying colors and brands of the bottle instead of just the bottle cap.

Painting and polishing fingernails also requires a degree of accuracy and stability. For example, users typically must paint their fingernails while holding their hand in the air. Some people find that their hands shake and require the hand to be rested on a table or other fixed surface. Others merely find that they need a surface to keep their hand from moving as they concentrate on the act of painting or polishing. The present invention solves this problem by including an elevated ramp that extends from the base of the present invention. The preferred embodiment of the elevated ramp extends at a 45-degree angle. The elevated ramp allows the user to rest his or her hand at an angle so that the grooming process can be achieved in an accurate and stable manner. The present invention also accommodates users facing the awkwardness of comfortably grooming their fingernails by forming a curvature into the front of the base of the present invention. The curvature is such that the present invention is more stable and close to the user's body as it wraps partially around the torso or lap.

U.S. Pat. No. 5,913,312 issued to Donnell on Jun. 22, 1999 is a nail polish bottle holder. Unlike the present invention, Donnell is formed from a sheet of flexible foam material with designated areas available so that polish bottles can be pushed into the foam. The present invention, in contrast, provides holes in such a manner that fingernail-grooming bottles can seamlessly be placed into a hole so that the bottle label or color is still easily identifiable. In addition, Donnell requires that a user's hand be rested on the surface of the foam. However, the present invention provides an elevated ramp for this purpose. The elevated ramp, along with other features of the present invention, can be securely fitted onto a base of the present invention. Meanwhile, a lip for spillage protection extends along the front of the base, the front of the base curved in such a manner as to wrap around the front of a person's body or around a lap. Donnell, in contrast, does not account for shape or angle that add to such important areas as stability, containment and ease of use.

SUMMARY OF THE PRESENT INVENTION

The present invention is a grooming station specifically catering to fingernails. The present invention is formed with a structural support that contains a base and curved back wall. The front of the base is curved in such a manner to wrap around the front of a person's body or otherwise fit seamlessly on and around a user's lap. The base also is formed with a lip with a raised edge so as to contain a spill. The preferred embodiment of the present invention also has two handles formed into the left and right sides of the curved back wall.

The surface of the base has an elevated ramp placed at the center of the base. The elevated ramp is at such an angle so that a user can rest his or her hand on the ramp with the fingers extended. When the fingers are extended, the fingernails will be positioned above the left compartment and the right compartment. The left compartment and right compartment are pockets formed with a depth to hold grooming products that may be heavier or shaped differently than normal bottles. The right compartment and left compartment are placed at the rear end of the center of the base to maintain balance as the heavier objects placed within the right compartment and left compartment will maintain an optimal and stable center of gravity.

Curving around the curved back wall is the left platform and right platform, also referred to herein as platforms. The platforms are elevated above the surface of the base. Holes are formed within the platforms where standard fingernail grooming product bottles can be placed through. While most holes are standard circumference, it should be noted that the preferred embodiment of the present invention also includes at least one wider hole so that a wider circumference bottle can be placed through. Segmented supports of the platforms are positioned incrementally from the surface of the base to the platforms. In this manner, the platforms are elevated in a stable manner. At the same time, the bottoms of the grooming product bottles are visible to the user. This means that a user can easily view varying colors of nail polish, etc.

DETAILED DESCRIPTION OF THE PREFERRED EMBODIMENT

Figure 1:
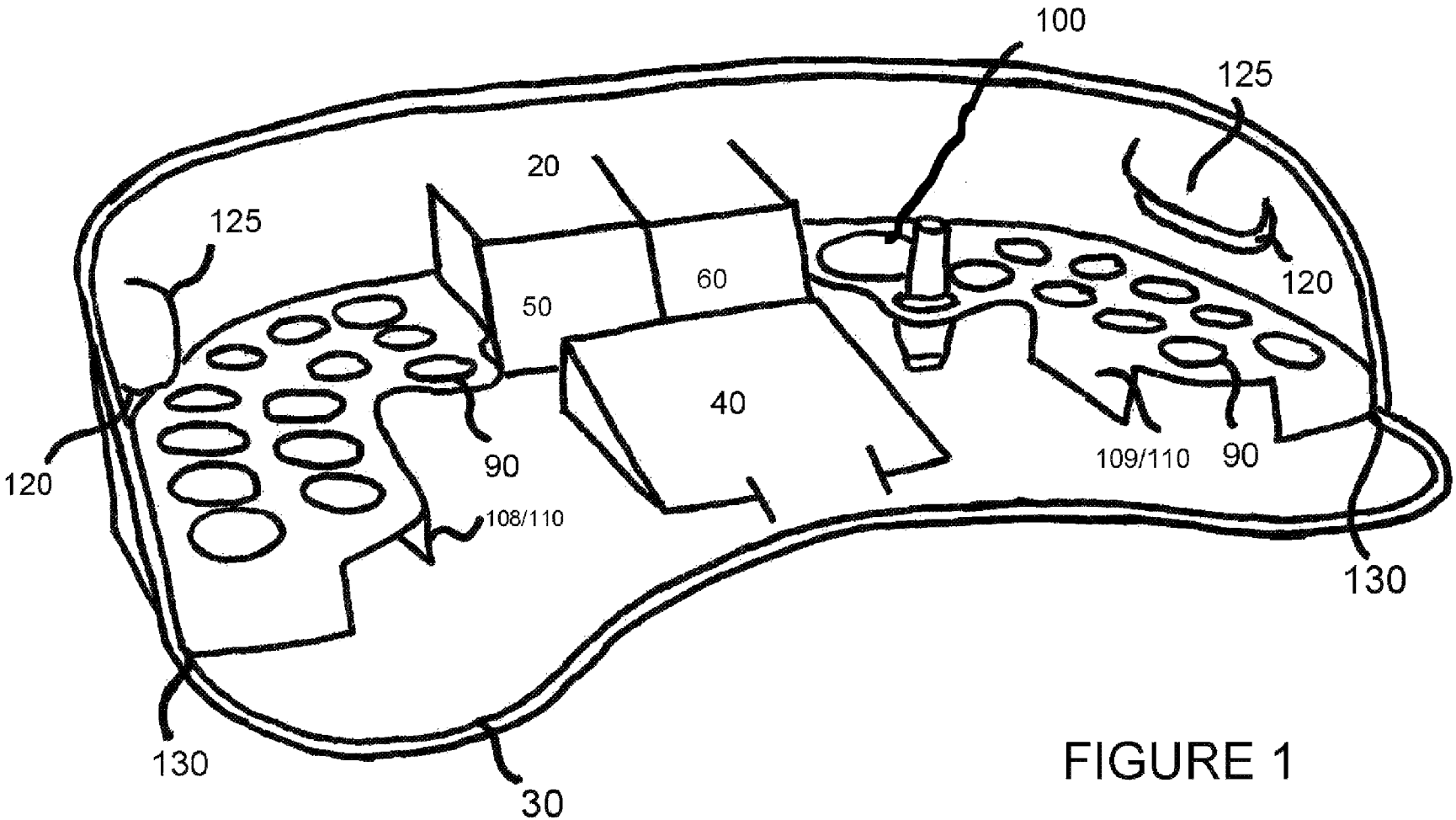
FIG. 1 is a front view of the present invention.

The present invention is a grooming station specifically catering to fingernails. It is portable and also is disposable in the preferred embodiment. As we see in FIG. 1, the present invention is formed with a structural support (5) that holds together a base (10) and curved back wall (20). The front of the base (10) is curved in such a manner to wrap around the front of a person's body or otherwise fit seamlessly on and around a user's lap. The base (10) and curved back wall (20) are made of a sturdy yet light and commonly disposable material such as cardboard. An additional embodiment envisions that the base (10) and curved back wall (20) are made of a conventional light plastic that is smooth and conducive to cleaning and wiping. The structural support (5) is lined around the edges of the base (10) and curved back wall (20). In this manner, the structural support (5) encircles the present invention so that it remains sturdy and supportive and therefore prevents flimsiness. The front of the base (10) also is formed with a lip (30) with a raised edge so as to contain a spill. The lip (30) extends from the structural base (5). The preferred embodiment of the structural base (5) and lip (30) envisions that these elements be composed of a relatively thin metal or hard plastic band that lines the present invention.

FIG. 1 also shows that the surface of the base (10) has an elevated ramp (40) placed at the center of the base (10). The elevated ramp (40) angled so that a user can rest his or her hand on the elevated ramp (40) with the fingers extended. When the fingers are extended, the fingernails will be positioned above the left compartment (50) and the right compartment (60). The left compartment (50) and right compartment (60) are pockets formed with a depth to hold grooming products that may be heavier or shaped differently than normal bottles. In addition, items such as files and clippers can be rested against or clipped onto the sides of the left compartment (50) and right compartment (60). The right compartment (60) and left compartment (50) are placed at the rear end of the center of the base (10) and abutting the center of the curved back wall (20) to maintain balance as the heavier objects and grooming products are placed within the right compartment (60) and left compartment (50) will maintain an optimal and stable center of gravity. The elevated ramp (40) and the left compartment (50) and right compartment (60) are composed of similar material as the base (10). But the angles and compact nature of these elements result in a condensed attribute that provides more stability and support. This is particularly true for the elevated ramp (40) because the compact nature of its angles permit the user to rest his or hand on the elevated ramp (40).

The curved back wall (20) is elevated and extends from the base (10) of which it is connected. The curved back wall (20) in the preferred embodiment extends higher than the left compartment (50) and the right compartment (60). The sides of the curved back wall (20) gradually lower in height until they reach a meeting point (130) with the sides of the curved back wall (20) and the base (10). In the preferred embodiment, the meeting point (130) is located adjacent to and also meets the end of the platforms (110) that are closest to the lip (30).

Curving around the curved back wall (20) is the left platform (108) and right platform (109), also referred to herein as platforms (110). The platforms (110) are elevated above the surface of the base (10). Holes (90) are formed within the platforms (110) where standard fingernail grooming product bottles can be placed through. While most holes (90) are standard circumference, it should be noted that the preferred embodiment of the present invention also includes at least one wider hole (100) so that a wider circumference bottle can be placed through. In addition, the preferred embodiment envisions that the holes (90) are not necessarily circular, but feature varying shapes and sizes. In this manner, the present invention accommodates varying types of grooming products such as square bottles, etc. It should be noted that the wider hole (100) of this description is representative of the fact that shapes and sizes of the holes (90) may vary.

Segmented supports of the platforms (110) are positioned incrementally from the surface of the base (10) to the platforms (110). In this manner, the platforms (110) are elevated in a stable manner. At the same time, the bottoms of the grooming product bottles are visible to the user. This means that a user can easily view varying colors of nail polish, etc. FIG. 1 offers an example of a nail polish bottle (150) placed within a hole (90).

The preferred embodiment of the present invention also includes a left handle and a right handle, hereinafter referred to as handles (120). The handles (120) are cut into the sides of the curved back wall (20). FIG. 1 offers the additional embodiment of handle flaps (125) emanating from the handles (120) so that a user can pop the handle flaps (125) into their original position for aesthetic or other purposes.

Figure 2:
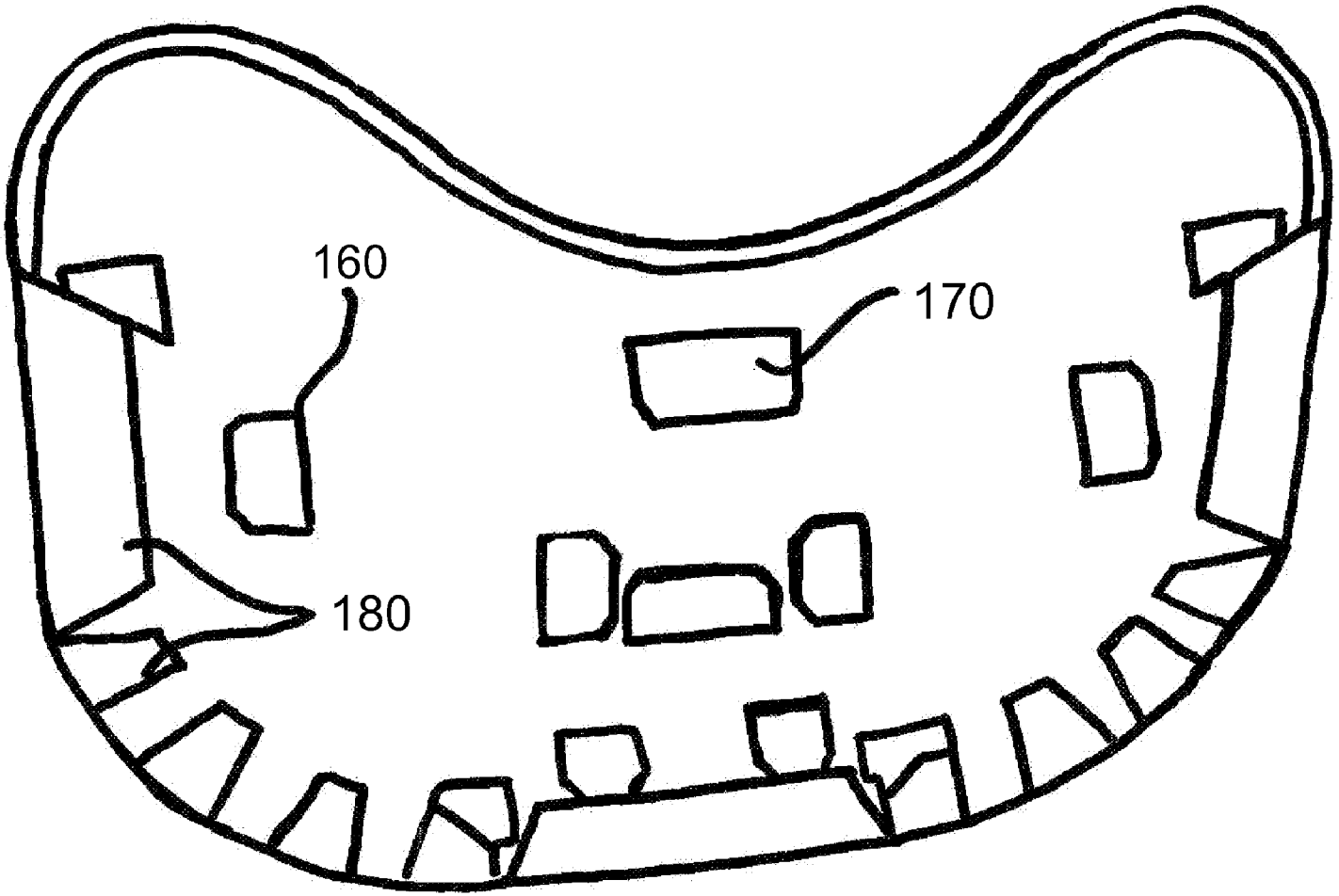
FIG. 2 is a bottom view of the present invention.

FIG. 2 is a view of the bottom of the present invention. In the preferred embodiment, each element of the present invention can be fitted into place via slits (160) cut into the base (10). In this manner, each platform (110), left compartment (50), right compartment (60), and elevated ramp (40) will have foldable bottoms (170) extending at various points on the bottom of these elements of the present invention. The foldable bottoms (170) in the preferred embodiment are conventional material with properties of being relatively sturdy and tight so that they remain securely in place after the foldable bottoms (170) are placed through the slits (160) and folded flush against the bottom of the base (10). The foldable bottoms (170) are configured to match the length and thickness of their corresponding slits (160). This means that, for example, the foldable bottoms (170) of the elevated ramp (40) will only be designated to fit properly into the slits (160) located at the front center and center of the base (10).

FIG. 2 also offers a view of the structural support bottoms (180). The structural support bottoms (180) in the preferred embodiment are formed in the same conventional manner as the foldable bottoms (170). However, the structural support bottoms (180) extend from the structural support (20) inward toward the center of the base (10). As we see in FIG. 2, the structural support bottoms (180) wrap tightly onto the bottom of the base (10) so as to connect the structural support (20) to the base (10). This means that if a user lifted the present invention by the structural support (20), the entire present invention would remain intact and together, along with any products placed within its confines. The same goes for lifting other elements of the present invention.

We claim:

1. A grooming station for a user's hand, comprising:

a structural support holding together a base and a curved back wall;

a front end at the front of said base, said front end having a curvature;

a lip extending around said base at its front, said lip configured with a raised edge;

an elevated ramp situated on said base, said elevated ramp extending upward and toward said curved back wall at an angle;

said curved back wall elevated and extending from said base;

platforms raised from the surface of said base, said platforms touching said base via segmented portions of said platforms;

holes configured to allow grooming products to be placed through said holes;

wherein at least one compartment is placed at a rear end of a center of said base, said at least one compartment abutting said curved back wall;

wherein said curvature extends entirely across said front end;

wherein said curvature is concave;

wherein said structural support is configured to encircle said base and said curved back wall;

sides of said curved back wall that slope downward until said sides of said curved back wall reach said base;

slits cut into said base;

wherein said platforms, said at least one compartment, and said elevated ramp have foldable bottoms;

wherein said foldable bottoms extend from bottoms of said platforms, a bottom of said at least one compartment, and a bottom of said elevated ramp;

wherein said foldable bottoms are configured to be placed through said slits;

wherein said foldable bottoms are folded flush against a bottom of said base;

wherein each of said foldable bottoms are configured to match length and thickness of each of said slits;

comprising structural support bottoms extending from said curved back wall toward a center of said base;

wherein said structural support bottoms extend under said base;

comprising bottles held within said holes;

comprising grooming products held within said at least one compartment; and handles in sides of said curved back wall.

* * * * *